United States Patent [19]

Tabler et al.

[11] 4,073,413

[45] Feb. 14, 1978

[54] DISPENSING APPARATUS WITH SELF CONTAINED SPOUT

[76] Inventors: Herman L. Tabler; Regine M. Tabler; Edwin L. Lokey, all of 313 Ellsworth Place, Oxon Hill, Md. 20024

[21] Appl. No.: 694,802

[22] Filed: June 10, 1976

[51] Int. Cl.[2] ..... B65D 25/44

[52] U.S. Cl. ..... 222/529; 222/530; 222/543

[58] Field of Search ..... 222/527–530, 222/543

[56] References Cited

U.S. PATENT DOCUMENTS

| | | | |
|---|---|---|---|
| 2,891,704 | 6/1959 | Morrison | 222/543 |
| 3,298,577 | 1/1967 | Chlystun | 222/530 X |
| 3,502,246 | 3/1970 | Kelbch | 222/529 X |
| 3,717,324 | 2/1973 | Milde | 222/528 X |

*Primary Examiner*—Robert B. Reeves
*Assistant Examiner*—John P. Shannon
*Attorney, Agent, or Firm*—Robert D. Farkas

[57] ABSTRACT

This disclosure pertains to a container having a collapsible corrugated spout stored in folded condition recessed below an exterior surface of the container. One end of the spout covers an opening in the container through which the spout passes when unfolded. The other end of the spout is closed by a removable cap. The spout is maintained by clamping forces adjacent the surface of the container when the spout is in an unfolded stored position.

5 Claims, 2 Drawing Figures

DISPENSING APPARATUS WITH SELF CONTAINED SPOUT

BACKGROUND OF THE INVENTION

1. The Field of the Invention

This invention relates to dispensing containers and more particularly to that class utilizing movable spouts for dispensing purposes.

2. Description of the Prior Art

The prior art abounds with disclosures utilizing spouts and closures associated with containers. U.S. Pat. No. 2,736,469 issued on Feb. 28, 1956 to A. K. Stone teaches a rigid spout which may be stored within the container by passing through an opening therein or, after removal and reversal of position, be secured to a threaded shoulder surrounding the opening, thereby providing a rigid pouring spout for communicating the fluid within the container in a directed fashion to selected sites outwardly therefrom.

U.S. Pat. No. 3,155,295 issued on Nov. 3, 1964 to C. W. Dearing discloses a container having an opening therein and a hollow cylindrical spout passing through the opening into the interior of the container. The spout may be pulled outwardly from the container and secured in an outward dispensing condition by the frictional engagement of a cylindrical protruberance on the spout with the side walls of the opening.

U.S. Pat. No. 3,856,188 issued on Dec. 24, 1974 to T. B. Newby pertains to a spout stored within the container and slideably partially extracted therefrom after breakaway opening in the lid of the container is removed. The exterior surface of the spout is wiped as the spout is withdrawn from the container in an effort to keep it clean from the material stored within the container.

All of the above mentioned Patents suffer the common deficiencies of allowing the material stored within the container to come into contact with the exterior surfaces of the spout when it is stored within the container, and further limit utility by utilizing spouts having a pre-determined shape and extended length when secured to the exterior surface of the container in an operable position.

SUMMARY OF THE INVENTION

A primary object of the present invention is to provide an inexpensive container and spout apparatus designed for one time use.

Another object of the present invention is to provide a self-storing spout whose exterior surfaces are incapable of contacting the contents of the container.

Still another object of the present invention is to provide a pouring spout which may be retracted from its stored position variable distances thereby increasing the utility of the container.

Yet another object of the present invention is to provide a retractable spout which can be extended outwardly from the container without requiring the use of threaded caps or ferrules.

A further object of the present invention is to provide a single closure device, such as a cap, which effectively seals both the container and the interior portions of the spout when in a stored or extended position.

Heretofore, spout devices did not form an integral part of the container. Thus the spout required a liquid type seal when in the stored position or when in the extended position. Furthermore, retractable spouts, because of the storage position within the container, allowed the exterior surfaces to be covered with the contents of the container, limiting their use for this reason and for the high cost of manufacture so as to exclude one time emergency automotive oil storage containers. The present invention eliminates these problems whilst additionally providing a spout that may be extended from the container having selected lengths and possessing flexibility thereby enhancing the ability to direct the liquid contents of the container in diverse directions therefrom.

These objects, as well as other objects of the present invention will become more readily apparent after reading the following description of the accompanying drawings.

DESCRIPTION OF THE PREFERRED EMBODIMENT

The structure and method of fabrication of the present invention is applicable to a cylindrical container having parallel circular lids at each end thereof. One lid is adapted with a circular opening disposed adjacent a marginal edge thereof. A corrugated flexible cylindrical spout, preferably fabricated from an inexpensive plastic material such as polyethylene, is provided. The marginal edges at one end of the spout are affixed about the opening to the interior surface of the lid having the opening disposed therein. The other marginal edges of the spout, adjacent the other end thereof, are adapted with a cap element hingeably affixed thereto, providing an openable closure for sealing the spout. The capped end of the spout is always maintained outwardly from the outermost surface of the lid. As the cap is displaced in a direction towards the lid, the spout inverts about its corrugations and is stored with its interior surface in contact with the contents of the container. The exterior surface of the spout never contacts the contents of the container regardless of the position of the spout. The corrugations in the spout provide flexibility therefor whilst maintaining the spout passageway in an open position.

A flange is provided on the exterior surface of the spout adjacent the capped end thereof. The exterior surface of the lid is provided with an inwardly turned flange element surrounding the opening therein. When the cap is displaced a sufficient distance in the direction of the container, the lid mounted flange snaps over the spout supported flange, maintaining the spout in a stored everted position substantially within the confines of the container. A withdrawing force exerted upon the portion of the spout adjacent the capped end thereof, causes the flanges to dis-engage and permits the controlled withdrawal during inversion, of selected lengths of the spout stored within the container. Upon removal of the cap, the contents of the container may be dispensed through the passageway of the spout, whose exterior extended surface remains dry and clean at all times.

Figure 1:
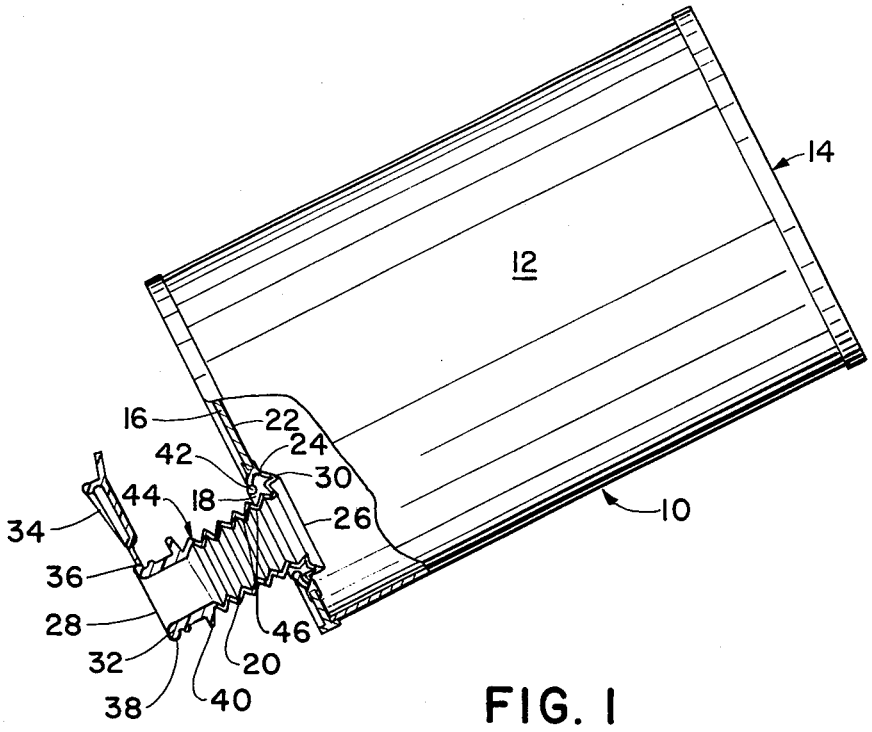
FIG. 1 is a side elevation view of the present invention showing an inverted extended spout.

Now referring to the Figures, and more particularly to the embodiment illustrated in FIG. 1 showing a container 10 having cylindrical side wall 12 to which is affixed a circular lid 14 at one end thereof. Lid 16, affixed to the other end of side wall 12 is adapted with opening 18. Corrugated flexible spout 20 is secured to the innermost surface 22 of lid 16 at point 24 at one end 30 thereof. The passageway of spout 20 terminates in opening 26 at end 30 and opening 28 at end 32 of the spout. Cap 34 is hingeably affixed at point 36 to end 32 of the spout for use in closing opening 28 by snapping over outwardly extending flange 38, secured at end 32 of the spout. Outwardly extending flange 40 is utilized to engage inwardly extending flange 42 when flange 40 is directed towards lid 16. The exterior surface 44 of spout 20, is protected from contacting the contents of the container, not shown, at all times. Corrugations 46 facilitate the unfolding ability and flexibility of spout 20.

Figure 2:
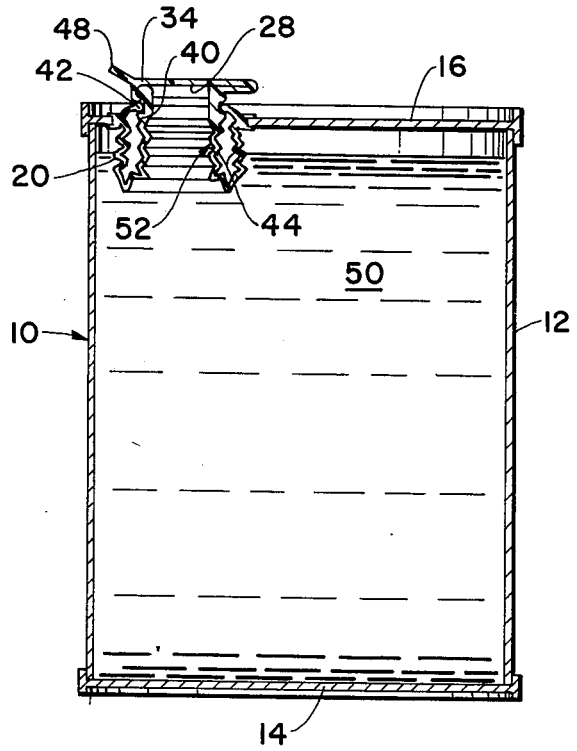
FIG. 2 is a cross-sectional view of the apparatus of the embodiment shown in FIG. 1 illustrating the spout in an everted, capped and stored position.

FIG. 2 illustrates container 10 having lowermost lid 14 and uppermost lid 16 secured to side walls 12 thereof. Cap 34 is shown having fingers gripping tab 48 affixed thereto. Spout 20 is shown in an everted stored position being maintained thereat by the engagement of flange 40 with inwardly turned flange 42. The exterior surfaces 44 of spout 20 being protected from the liquid contents 50, within the container, such as oil and the like. The interior surface 52 of the spout is maintained in contact with contents 50 at all times, though retained within container 10 until such time that cap 34 uncovers opening 28 at the distal end of the spout.

One of the advantages of the present invention is an inexpensive container and spout apparatus designed for one time use.

Another advantage of the present invention is a selfstoring spout whose exterior surfaces are incapable of contacting the contents of the container.

Still another advantage of the present invention is a pouring spout which may be retracted from its stored position variable distances thereby increasing the utility of the container.

Yet another advantage of the present invention is a retractable spout which can be extended outwardly from the container without requiring the use of threaded caps or ferrules.

A further advantage of the present invention is a single closure device, such as a cap, which effectively seals both the container and the interior portions of the spout when in a stored or extended position.

Thus, there is disclosed in the above description and in the drawings, an embodiment of the invention which fully and effectively accomplishes the objects thereof. However, it will become apparent to those skilled in the art, how to make variations and modifications to the instant invention.

Therefore, this invention is to be limited not by the specific disclosure herein, but only by the appending claims.

I claim:

1. A dispensing apparatus with self contained spout comprising a container, an opening in said container, a flexible corrugated elongated cylindrical tubular spout, one end of said corrugated spout fixedly secured to the interior surface of said container surrounding said opening, openable closure means for selective closure of the other end of said corrugated spout, said other end of said corrugated spout passing through said opening and residing outwardly from the exterior surface of said container adjacent said opening, first portion of the length of said corrugated spout being disposed residing within second portion of said length of said corrugated spout when said other end of said corrugated spout is disposed in an adjacent position to said exterior surface, said first portion of the length of said corrugated spout being disposed outwardly and adjacent to said second portion of the length of said corrugated spout when said other end of said corrugated spout is disposed outwardly from said adjacent position, spout locking means for removably locking said corrugated spout in said everted position, said spout locking means including a second flange, said second flange fixedly secured adjacent said other end of said corrugated spout and extending radially outwardly therefrom, a third flange, said third flange being fixedly secured to said exterior surface surrounding said opening and extending radially inwardly therefrom, said second flange being disposed intermediate said third flange and the interior confines of said container when said other end of said corrugated spout is disposed in said adjacent position.

2. The dispensing apparatus with self contained spout as claimed in claim 1 wherein said closure means comprises a cap, a first flange, said first flange fixedly secured to said other end of said corrugated spout and extending radially outwardly therefrom, said cap frictionally engaging said first flange when said cap seals the passageway of said corrugated spout adjacent said other end thereof.

3. The dispensing apparatus with self contained spout as claimed in claim 2 further comprising hingeing means for flexibly hingeably securing said cap to said other end of said corrugated spout.

4. The dispensing apparatus with self contained spout as claimed in claim 1 wherein said corrugated spout is fabricated from polyethylene material.

5. The dispensing apparatus with self contained spout as claimed in claim 1 wherein said container comprises a hollow cylindrical wall, a pair of circular lids, one of said pair of circular lids fixedly secured to one end of said hollow cylindrical wall, the other of said pair of circular lids fixedly secured to the other end of said hollow cylindrical wall, said opening being disposed in said one of said pair of circular lids adjacent a marginal edge thereof.

* * * * *